United States Patent [19]

Arnold

[11] Patent Number: 4,798,303

[45] Date of Patent: Jan. 17, 1989

[54] CONTINUOUS THREAD CLOSURE ASSEMBLY

[75] Inventor: Donald L. Arnold, Madison, Conn.

[73] Assignee: Chesebrough-Pond's Inc., Greenwich, Conn.

[21] Appl. No.: 143,794

[22] Filed: Jan. 14, 1988

Related U.S. Application Data

[63] Continuation-in-part of Ser. No. 038,685, Apr. 15, 1987, abandoned.

[51] Int. Cl.[4] ..... B65D 41/04

[52] U.S. Cl. ..... 215/329

[58] Field of Search ..... 215/329, 318; 220/288, 220/293

[56] References Cited

U.S. PATENT DOCUMENTS 2,074,830 3/1937 Conner ..... 215/329

FOREIGN PATENT DOCUMENTS 2323561 11/1974 Fed. Rep. of Germany ..... 215/329

*Primary Examiner*—Donald F. Norton

*Attorney, Agent, or Firm*—Melvin H. Kurtz

[57] ABSTRACT

A continuous thread closure assembly is described which achieves a required degree of full thread engagement between cap and container with a lessened amount of turning of the cap needed to achieve such engagement. The assembly comprises a container having a sloping, continuous thread finish thereon having a progressively increasing thread diameter in a direction away from the outlet of the container at a conical angle of at least about 40°. A screw cap is provided having a compressible liner, if desired, on the inside of its top and a counterpart thread configuration to that of the container on the inside skirt portion thereof. The thread configuration on the cap is directly engageable with the container in such a manner that the lowest thread portion of the cap passes over the uppermost thread portion on the container without engagement thereof but is engageable with the next lower thread portion to allow for less than one turn of the cap to give greater than one full course or turn of thread engagement between the container and the cap.

4 Claims, 2 Drawing Sheets

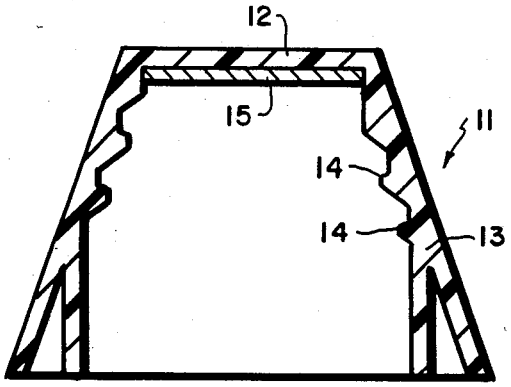
FIG.1
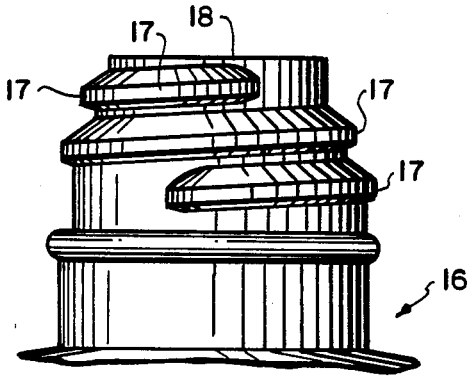
FIG.2
FIG.3
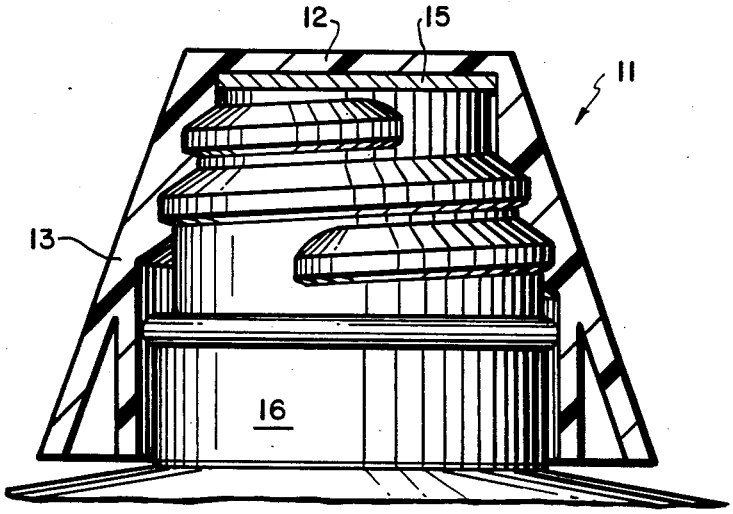

FIG.4A
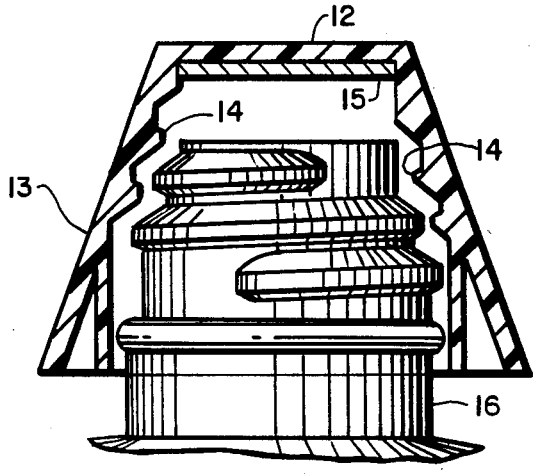
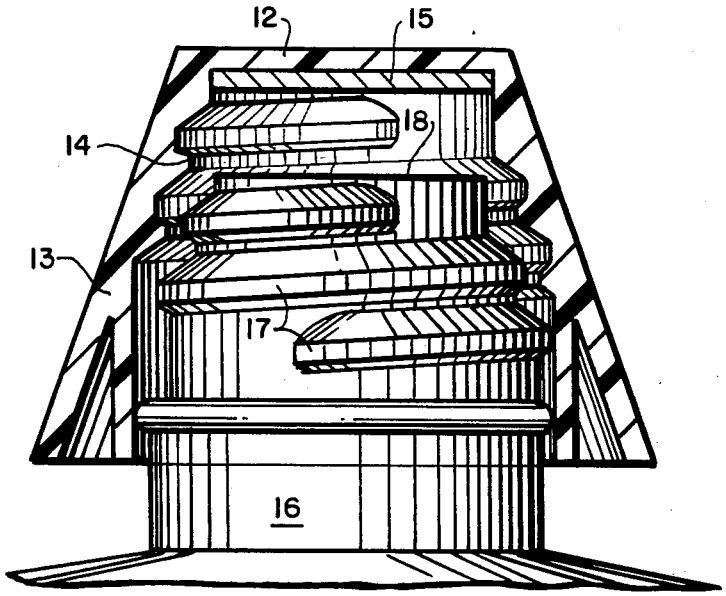
FIG.4B

CONTINUOUS THREAD CLOSURE ASSEMBLY

CROSS-REFERENCE TO RELATED APPLICATION

This application is a continuation-in-part of U.S. Ser. No. 038,685 filed Apr. 15, 1987, now abandoned.

BACKGROUND OF THE PRESENT INVENTION

1. Field of the Present Invention

The present invention is a continuous strong thread closure assembly which is designed to achieve optimum thread engagement with a minimum amount of turning of the cap.

2. Description of the Prior Art

Continuous thread bottle and container assemblies are well known to persons of ordinary skill in the art. In general, it is quite common for the container to have a sloping, continuous thread finish which has a constant thread diameter from top to bottom. The screw cap can, preferably, have a compressible liner on the inside of its top and has a counterpart thread configuration to that of the container on the inside surface of its skirt. Such conventional designs call for direct engagement of the lowest thread portion of the cap with the uppermost thread portion of the container. Such conventional screw cap/container assemblies require a substantial amount of turning of the cap before there is optimum thread engagement and, optionally, liner compression to seal the assembly.

The present invention is directed to a modified continuous thread closure assembly which achieves optimum thread engagement with a lessened amount of turning of the cap. It is a distinct consumer advantage and yet provides a closure assembly which has good sealing properties.

The prior art known to the present inventor does not appear to suggest the present invention and has never been practiced commercially. For example, U.S. Pat. No. 650,429 shows a refillable gas capsule having a "frustoconical" threaded neck which is described as having unspecified conveniences in manufacture and in applying a cap thereto. This patent fails to teach a closure assembly wherein the screw cap has a counterpart thread configuration such that the lowest thread portion on the cap passes the uppermost thread portion on the container so as to be engageable with a lower thread portion on the container to allow for more than one full turn of thread engagement between the threads on the cap with less than one turn of the cap.

U.S. Pat. No. 759,168 shows a jar closure which contains a rubber ring between the cap and the container finish. This fails, for example, to suggest the present modified closure assembly which has direct engagement between the threads on the container and the cap.

U.S. Pat. No. 3,297,187 shows closure devices for containers, jars and the like which have a tapered shape for the contacting surfaces on the cap and the jar. The closure member in this patent is applied to the container by pushing down, by hand, rather than by rotation of the cap onto the jar as in the present invention.

German published application 2,323,561 discloses a closure having a multiple thread turns of a saw-tooth profile and a taper cone angle of 30 degrees. The closure can be firmly closed with a half turn. The closure occurs by way of a depression in the cap plugging the hole in the neck of the container. The many saw-tooth profile threads of the device disclosed in the German application tend to chip and are not inherently strong.

It is an object of the present invention to provide a closure which is inherently strong, does not chip easily and can provide two full turns of thread engagement with less than one turn of the cap.

SUMMARY OF THE PRESENT INVENTION

The present invention is a continuous thread closure assembly which comprises a container and a screw cap. The container has a sloping, continuous thread, with a cone angle of at least about 40°, which has a progressively increasing thread diameter as one moves in the direction away from the outlet of the container. The screw cap of the present assembly can have a compressible liner on the inside of its top, if desired, and has a counterpart thread configuration to that of the container on the inside surface of its cap skirt. The thread configuration on the screw cap is directly engageable with the thread finish on the container in a particular manner so as to achieve optimum thread engagement with a lessened amount of turning of the cap than heretofore possible with conventional designs. The lowest thread portion of the present cap is dimensioned so that it passes over the uppermost thread portion on the container and does not engage it. Rather, it engages the next lower thread portion on the container so as to allow for greater than one full turn of engagement between the threads on the container and the threads on the cap with less than one full turn of the cap. Preferably, one-half turn of the cap will tighten the cap for a reliable seal while at the same time achieving about two full turns of thread engagement to thereby inhibit back-off.

DESCRIPTION OF THE DRAWINGS

The present invention is further understood by reference to the drawings which form a portion of the present specification wherein:

FIG. 1 is a fragmentary cross-sectional view of an embodiment of a cap of the continuous thread closure assembly of the present invention;

FIG. 2 is a side view of the container having two full turns of a sloping, continuous thread finish and progressively increasing thread diameter in a direction away from the outlet of the container;

FIG. 3 shows the cap of FIG. 1 fully seated on the container shown in FIG. 2;

FIG. 4A is a composite view showing the cap (as illustrated in FIG. 1) and the container (as illustrated in FIG. 2) in superimposed view showing the position of the cap and container before the cap threads make engagement with the threads on the container; and FIG. 4B is a view of the cap and container in the position they occupy in FIG. 4A with the inside thread structure of the cap illustrated.

DETAILED DESCRIPTION OF THE PRESENT INVENTION

FIG. 1 shows the cap 11 of the present invention. It comprises a top 12 and a cap skirt 13 having threads 14 formed on the inner surface thereof. The threads are of the modified buttress profile. The threads useful in the present invention are preferrably of Type A or Type B as defined by the Glass Packaging Institute or of modified buttress profile. A compressible liner 15 can be placed on the inner surface of cap top 12, if desired. As can be seen in FIG. 1, the skirt 13 is inclined at a certain angle to the vertical (e.g., about 20°) so as to give the cap a generally conical shape if viewed from perspective. The conical angle of the skirt is at least about 40° (twice the angle to the vertical) to achieve the advantages of the present invention. The conical angle of the screw cap must be at least about 40° so that the thread can be made strong, that only two full threads are required and that maximum surface contact can be achieved between the threads to provide a secure seal with a tendency to prevent back-off. The preferred combination of a modified buttress thread profile and a cone angle of at least about 40° provides for a closure which can achieve two full turns of thread engagement with about one-half turn of the cap.

The design provides for ease of closing the container when it is filled at the production facility and for rapid closure by less than a full turn of the cap by the user of the container.

FIG. 2 shows the container 16 having two full turns of a continuous thread structure of a modified buttress profile 17 on its outer surface. The thread surface 17 is configured to cooperate with threads 14 on the inner surface of the skirt 13 of cap 11 and can be of the Type A, Type B or modified buttress profile design. The thread diameter (i.e., the diameter from the outer surface of each course or portion of the threads) is generally increasing in a direction away from the outlet 18 of the container 16. This generally increasing thread diameter gives the diameter a generally conical form with a cone angle of at least about 40°, which matches the cooperating portions of the thread structure 14 on the inner surface of the cap skirt 13. That is, the conical angle of the thread structure must be at least about 40° to provide strong threads and prevent cap override and backing off.

The use of such a structure in dimensioning the container threads and the matching cap threads allows for the lowermost portion of the threads on the cap 11 to pass over the uppermost portion or first turn or course of the threads on the container 16. FIGS. 4A and 4B illustrate the orientation of cap and container prior to engagement of the lowermost threads on the cap with the second course or turn of threads on the container. The lowermost threads on cap 11 engage with the next lower threads on the container, thereby allowing a person to rotate the cap for only a portion of the rotational distance (less than a full turn) needed to fully engage the cap as compared to conventional thread designs where the thread diameter is non-sloping and is of non-conical shape. The present design allows a person to achieve the desired full engagement between the threads on the cap and container with the desired liner compression (when a liner is used) to seal the assembly without having to rotate the cap as much as would be necessary for conventional configurations. The present invention provides a closure assembly (container and cap) which is sealable using less rotational effort than conventional designs and, yet, gives the full degree of thread engagement between cap and closure and the desired degree of liner compression.

The need for only about two full turns of the threads on the container coupled with a conical angle greater than about 40° provides for a structure which is easy to fabricate, is strong, provides for tight closure with minimum effort and a low tendency for cap override. Since only about two full thread turns on the container are required, the threads can be broad and accommodate a relatively high stress without chipping or cracking.

The foregoing illustrates certain preferred embodiments of the present invention but should not be construed in a limiting sense. The scope of protection that is sought is set forth in the claims which follow.

I claim:

1. A continuous thread closure assembly which comprises:

(a) a container having only about two full turns of a continuous thread finish of a Type A, Type B or modified buttress profile thereon which has a progressively increasing thread diameter in a direction away from the outlet of the container at a conical angle of at least about 40°; and (b) a screw cap having a top with a counterpart thread configuration to that of the container on the inside surface thereof which directly engages with the thread finish on the container in such a manner that the lowest thread of the cap passes the uppermost thread on the container and is engageable with the next lower thread course on the container to allow for less than one turn of the cap to give two full turns of thread engagement between the container and cap.

2. An assembly as claimed in claim 1 wherein one-half turn of the cap achieves two full turns of thread engagement between cap and container.

3. An assembly as claimed in claim 2 wherein a compressible liner is attached to the inside top surface of the cap.

4. An assembly as claimed in claim 1 wherein a compressible liner is attached to the inside top surface of the cap.

* * * * *